United States Patent [19]

Johnson

[11] 4,354,560

[45] Oct. 19, 1982

[54] APPARATUS FOR DRILLING ENLARGED BOREHOLES

[75] Inventor: Gary R. Johnson, Yorba Linda, Calif.

[73] Assignee: Tri-State Oil Tool Industries, Inc., Bossier City, La.

[21] Appl. No.: 315,184

[22] Filed: Oct. 26, 1981

Related U.S. Application Data

[62] Division of Ser. No. 173,836, Jul. 30, 1980.

[51] Int. Cl.[3] ..... E21B 10/18; E21B 10/34

[52] U.S. Cl. ..... 175/267; 175/215; 175/286; 175/337; 175/339

[58] Field of Search ..... 175/267, 215, 340, 339, 175/337, 286, 71

[56] References Cited

U.S. PATENT DOCUMENTS

| | | | |
|---|---|---|---|
| 2,941,785 | 6/1960 | Kammerer | 175/267 X |
| 3,196,961 | 7/1965 | Kammerer | 175/267 |
| 3,198,267 | 8/1965 | Madson | 175/215 X |
| 3,667,555 | 6/1972 | Elenburg | 175/215 X |
| 3,948,330 | 4/1976 | Langford, Jr. | 175/213 X |
| 4,189,185 | 2/1980 | Kammerer et al. | 175/267 X |
| 4,293,048 | 10/1981 | Kloesel, Jr. | 175/215 X |

*Primary Examiner*—Stephen J. Novosad
*Attorney, Agent, or Firm*—Bernard Kriegel

[57] ABSTRACT

A rotary bore hole enlarging bit is connected to a rotary pipe string having a drilling fluid flow path and an actuator flow path. The bit comprises a body structure including inner and outer telescopic body sections, expansible and retractible arms carrying cutters on the outer body section and an expander on the inner body section engageable with the arms to expand the arms and cutters upon telescopic movement of body sections in one relative direction. A piston and cylinder is provided between the inner and outer body sections to secure relative telescopic movement between the body sections. A first passage is disposed in the body structure and expansible arms and cutters for conducting drilling fluid to the cutters from the drilling fluid flow path, there being a second passage in the body structure for conducting actuator fluid to the piston and cylinder from the actuator fluid flow path.

6 Claims, 15 Drawing Figures

240
150
183
151
184
5
5
186
185
159
182
EB
177
179
172
173
159a
196
178
6
6
197
180
193
194
17
195
171
169
181
187
17d
241
189
188
17c
17b
C

APPARATUS FOR DRILLING ENLARGED BOREHOLES

This application is a division, of application Ser. No. 173,836, filed July 30, 1980.

In the forming of bore holes in the earth, more particularly enlarged bore holes, for example, blast holes used in bench mining or quarrying, it has become the practice to drill a pilot hole to a given depth and enlarge the hole to form a large chamber for receiving a blasting explosive. Such bore holes are also useful in connection with in-situ fragmentation for chemical mining and coal gasification techniques.

Accordingly, hole openers, including expansible drill bits, have evolved. Some of the expansible drill bits have included a pilot bit in combination with expansible cutters to drill a pilot hole and also drill out an enlarged chamber. When drilling with liquid or mud as a drilling fluid to cool the cutters and flush cuttings from the bore hole, it is customary to circulate the drilling fluid down a length of drill pipe or tubular conduit, and the fluid returns through the annulus between the pipe and the bore hole to flush cuttings from the hole.

In the case of certain bore hole drilling operations, both in the formation of blast holes and other bore holes, air or gas is employed as the drilling fluid to cool the cutters and remove the cuttings from the bore hole. However, the effective removal of cuttings by air requires a relatively high bailing velocity, as compared with liquid drilling fluids. According to most authorities, air bailing velocities on the order of five thousand feet per minute of air are required.

When bore holes are being drilled using air as a drilling fluid, it will be appreciated that such bailing velocity of the air through the annulus, surrounding the drill pipe may be difficult to accomplish or may require compressor capacity at the drilling rig in excess of that available or economically practical to obtain. Moreover, even if added compressors can supply sufficient air to cause the effective bailing of cuttings through the bore hole annulus, the velocity of air and dust returning through the reduced annular space above the enlarged chamber or bore hole would be objectionably noisy and environmentally undesirable at the outlet, and the abrasive nature of the cuttings and dust would be damaging to the drill pipe and the integrity of enlarged bore hole, such as blast holes. In the case of blast holes, particularly, erosion of the shoulder at the beginning of the enlarged chamber is undesirable in that the blasting effectiveness is reduced.

So called reverse circulation of drilling fluid has been resorted to in an effort to supply drilling fluid at adequate bailing velocity. The reverse circulation involves circulating air downwardly through the bore hole annulus and upwardly through the bit and drill pipe, the velocity in the relatively small bore of the pipe being quite high due to the small cross-sectional area of the flow passage.

In addition, circulation of the drilling fluid through so-called dual concentric pipe strings has been resorted to in some drilling operations. Dual concentric pipe strings involve providing concentric inner and outer pipes having connections which provide flow passages establishing communication with the annular space between the pipe sections, as well as through the central pipe bore. However, providing a good seal at the pipe connections and adequate wrench areas or tool slots for making up and breaking out the connections, while maintaining adequate flow area, are problems in dual concentric drill pipe.

When expansible, pivoted cutter supporting arms on drill bits are actuated outwardly by air pressure to initiate an enlarged bore hole, the flow of air to the cutters, in air cooled cutter bits, may be so great that inadequate pressure is present to effect expansion of the cutters in a reasonably short period of drilling, so that a long tapered side wall is formed on which the back or outer surfaces of the pivoted cutter arms may drag and wear. Thus, it is desirable that the expansive force be maintained on the arms which carry the cutters, while not depriving the cutters of sufficient cooling air during the early stages of bore hole enlargement.

In the formation of blast holes in mining or quarrying operations, it has been found that a two-pass method of first drilling a pilot hole with a first drill bit and drill string, and then, in a second pass, enlarging the hole with an expansible bit run on the second drill string, produces a superior blast hole shape, if the bore hole enlargement is continued substantially to the bottom of the pilot hole. Since the annular bore hole space outside the drill string, when drilling the pilot hole is not large in cross-sectional flow area, the drilling fluid or air can be normally circulated down the drill string and up the annulus, and the bailing velocity of the fluid or air in the annulus may be adequate. However, such practice requires substantial air circulating capacity and results in environmentally undesirable dust and noise at the top of the bore hole. Thereafter, however, when the second, hole enlarging pass is being made, the enlargement of the bore hole may so increase the annular flow area that the necessary air bailing velocity through the bore hole annulus may not be obtained with existing compressors, and if sufficient compressed air is made available, the cost is high.

When forming blast holes by the two-pass method to provide a more-or-less flat bottomed enlarged chamber, as more particularly disclosed U.S. Pat. No. 4,189,185, granted Feb. 19, 1980, it is desirable that the bottom of the hole be relatively free from cuttings and accumulated dust at the conclusion of the drilling. Accumulated debris at the bottom of the hole can cushion the explosive effect and interfere with bench removal or effective fragmentation.

The inventions of my U.S. Pat. No. 4,187,920, issued Feb. 12, 1980 provide for forming enlarged bore holes or blast holes utilizing a two-pass method and reverse circulation through a dual concentric pipe string during the bore hole enlargement drilling, the dual concentric pipe string also being utilized during the drilling of the pilot hole. The method and apparatus provide substantial benefits in terms of bailing velocity and cutting removal.

The present invention relates to an improved method and improved apparatus employing a dual concentric pipe and reverse circulation during the drilling of a bore hole, and in practice of the two pass method of drilling blast holes, improved reverse circulation is employed during both the pilot bore hole drilling and during the enlargement of the bore hole.

In addition, the present invention provides improved drilling air circulation and vacuum in a novel manner which have advantages from an environmental standpoint, as well as from the standpoint of efficient cuttings removal, in a more economical manner.

In accomplishing the above, the invention involves a dual concentric pipe string adapted to conduct air down the outer pipe to a cross-over from which air is directed to the bit, or in the case of blast hole drilling, to the pilot bit and to the expansible bit, to cool the bearings and initiate upward movement of cuttings, to prevent their regrinding. Above the cross-over is a suction inlet leading from the bore hole into the inner pipe, and the inner pipe is subjected to a vacuum pump or blower at the top of the hole which removes a volume of air from the bore hole, through the inner pipe, in excess of the volume of drilling air passing through the bit. Since the cross section of the inner pipe flow area is small, the bailing velocity is high, but the volume need not be great, as in the case of bailing through the bore hole annulus. Moreover, the vacuum removal of air in excess of the drilling air creates a negative pressure at the top of the bore hole annulus and a flow of make-up air down the annulus, so that the dust cannot escape to the atmosphere at the top of the hole. In the case of blast hole drilling using the above-described two pass method, the integrity of the blast hole shape is maintained.

Further, the hole opening or expansible cutter bit of the present invention is preferably constructed in a manner that the cutters can be hydraulically expanded, while air is continuously circulated through the cutters, as they are being expanded. Additional air is jetted at the cutters when they are fully expanded. When this additional air exits from the bit a tattle-tail pressure difference indicates at the top of the hole that the cutters are fully expanded, and further the volume of jetted air is sufficient to blow cuttings to the suction inlet above the bit, avoiding regrinding of these cuttings.

The hole opening or expansible bit cutter is constructed so that, during drilling, the cutters are held expanded. In the preferred form, the cutters can be hydraulically expanded and retracted. Hydraulic fluid can be supplied to the expansible cutter bit to expand or retract the cutters through one or two conduits installed between the inner and outer pipes of the dual concentric pipe string. When the expansible cutters are both expansible and retractible by hydraulic pressure, a selector valve is preferably associated with the drilling swivel and the swivel is provided with a fluid chamber selectively communicating through the valve with a selected conduit. The conduits lead to a double acting piston and cylinder structure to expand and retract the cutters.

In some operations, the bore hole is relatively shallow, so that a single length of pipe extends between the swivel and the bit. However, for deeper holes, one or more additional lengths, of pipe may be added. Thus, the invention also provides a tool joint or connection for the dual concentric pipe, and the swivel and bit, as well as one or more additional pipe lengths, the joints having the companion passageways for the flow of air down the outer pipe and up the inner pipe, as well as providing hydraulic connections when the expansible cutters are to be hydraulically expanded or hydraulically expanded and retracted.

This invention possesses many other advantages and has other purposes which may be made more clearly apparent from a consideration of forms and methods embodying the invention. These forms and methods are shown and described in the present specification and in the drawings accompanying and constituting a part thereof. They will now be described in detail, for the purpose of illustrating the general principles of the invention; but it is to be understood that such detailed description is not to be taken in a limiting sense.

REFERRING TO THE DRAWINGS

FIGS. 1*a* and 1*b* together constitute a view diagrammatically showing the drilling of a bore hole, such as a pilot bore hole, into earth formation, utilizing the reverse circulation through the dual drill pipe string of the invention, FIG. 1*b* being a downward continuation of FIG. 1*a;*

FIGS. 2*a* and 2*b* together constitute a view diagrammatically showing the enlargement of the pilot bore hole of FIGS. 1*a* and 1*b,* in accordance with the two pass method, utilizing the expansible bit of the invention and reverse circulation through the dual pipe string, FIG. 2*b* being a downward continuation of FIG. 2*a;*

FIG. 2*c* is a diagrammatic illustration of the valve embraced by the line 2*c* of FIG. 2*a;*

FIGS. 3*a* and 3*b* together constitute an enlarged vertical section as taken on the line 3—3 of FIG. 2*b* showing the expansible bit used to enlarge the bore hole, with the cutters in retracted condition, FIG. 3*b* being a downward continuation of FIG. 3*a;*

FIGS. 4*a* and 4*b* constitute a view corresponding with FIGS. 3*a* and 3*b,* but showing the cutters expanded to enlarge the bore hole;

Figure 1A:
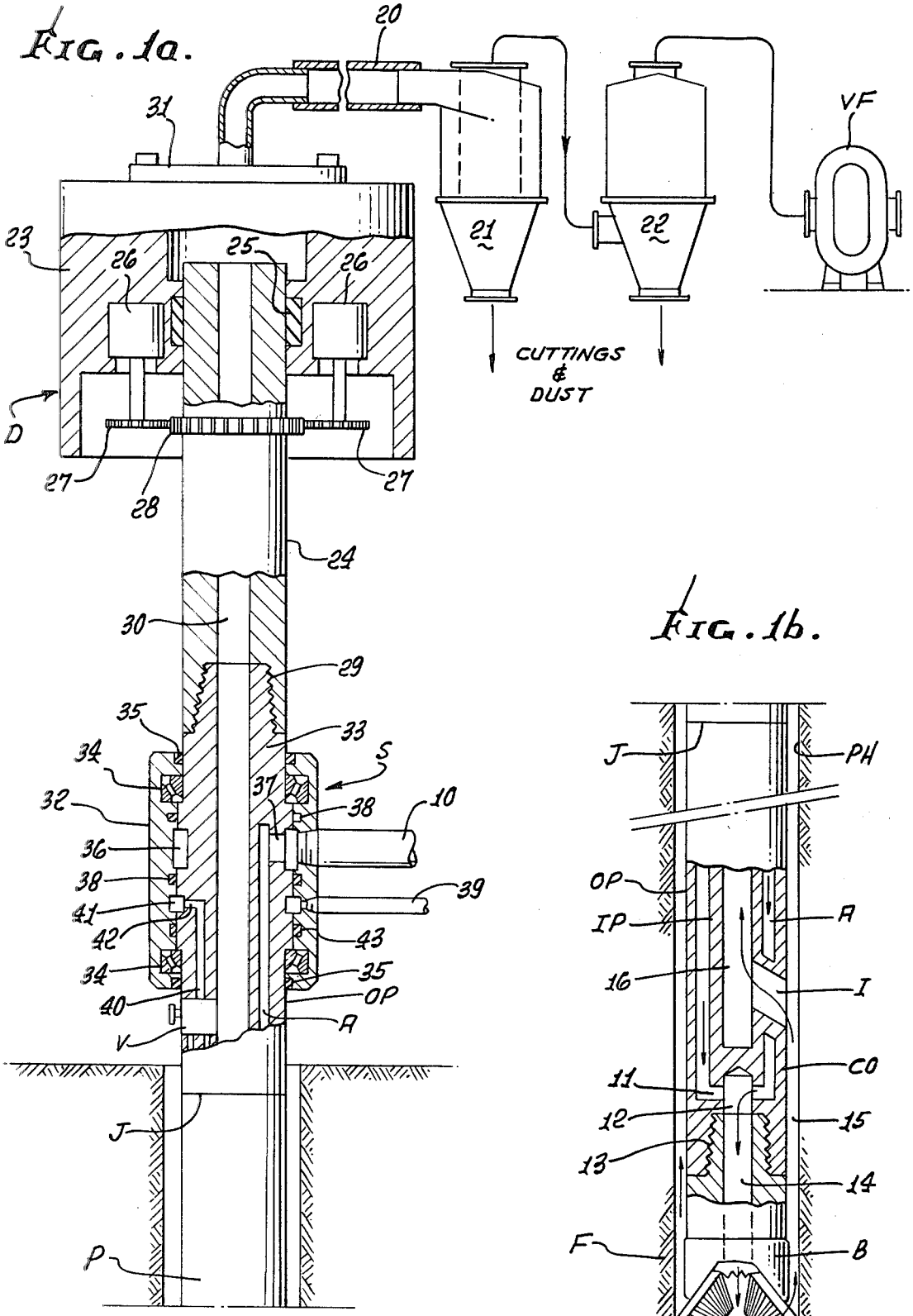
Figure 1B:
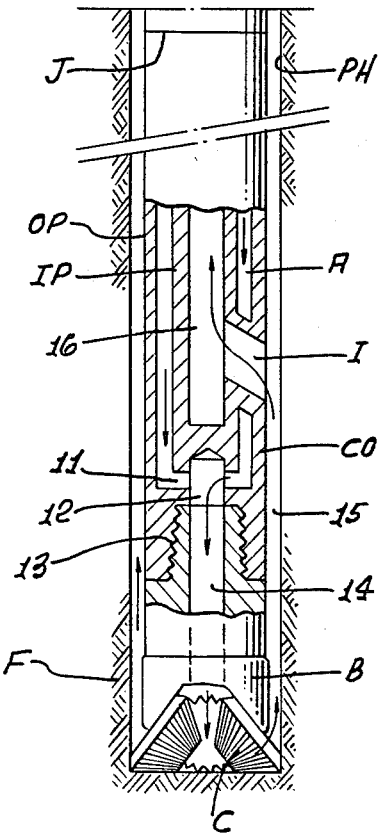
Figures 2A, 2B:
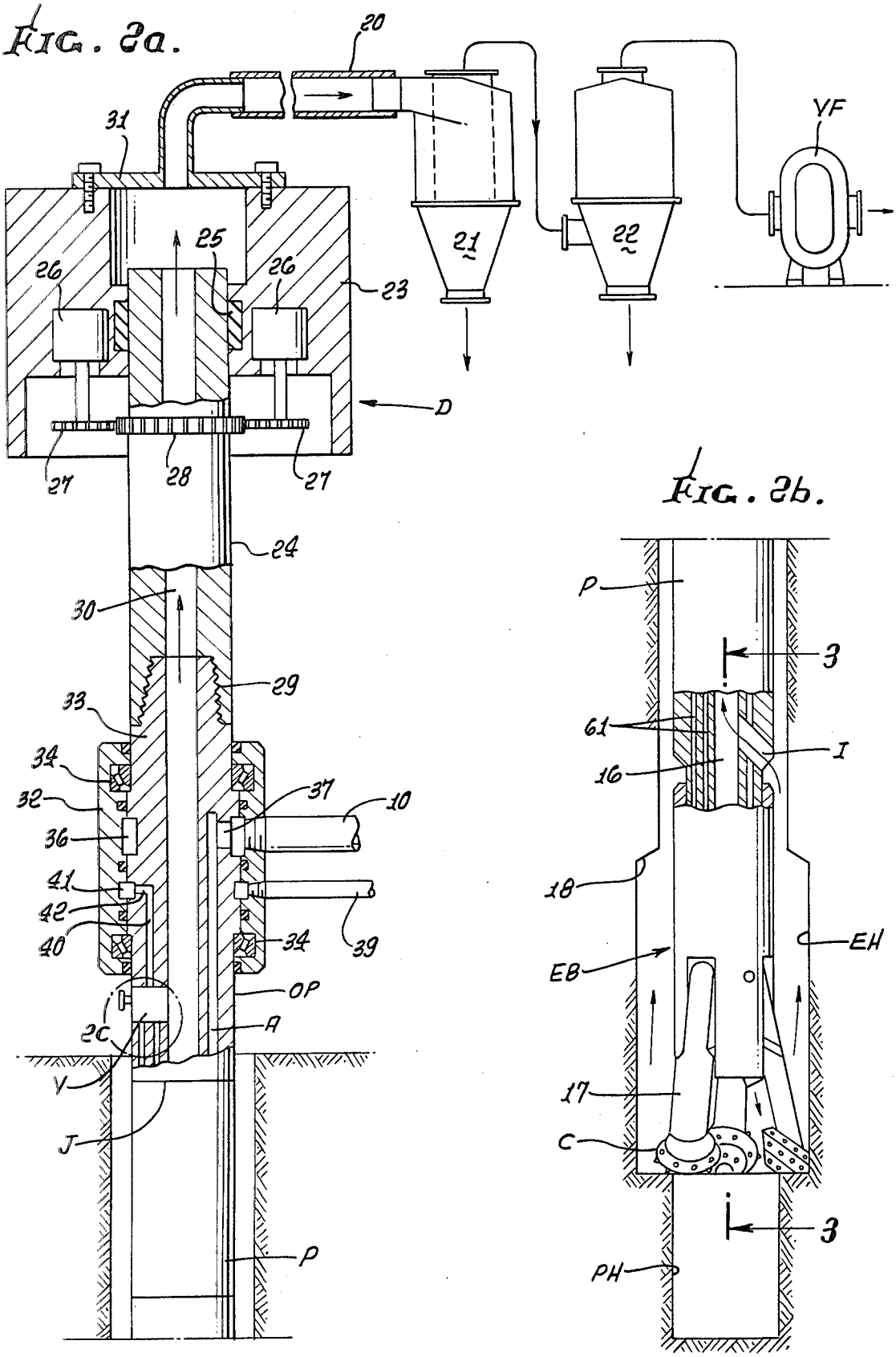

As seen in the drawings, referring first to FIGS. 1*a* and 1*b,* apparatus is diagrammatically illustrated for drilling a bore hole, such as drilling a pilot bore hole PH (FIGS. 1*a* and 1*b*) by drilling through the earth formation F with the usual drill bit B, secured to the lower end of a string of rotatable drill pipe P adapted to be rotated by a suitable rotary drive unit D, whereby the cutters C on the bit B progressively drill the bore hole or pilot hole PH, as the drill pipe P is rotated, and drilling fluid is supplied through the swivel S from a suitable source of drilling fluid, such as a compressor for air, in the case of drilling with air, via a supply conduit 10. As illustrated, the drill pipe string P is a dual concentric drill pipe having an inner pipe IP and an outer pipe OP, made up in appropriate lengths or sections secured together at joints J, and defining an annular space A therebetween communicating through the respective joints, whereby drilling fluid or air supplied through the swivel S from the pipe 10, through the annular space A, to a crossover CO in which the annular space A communicates through lateral passages 11 with a central bore 12 at the lower end of the crossover. The bit B is connected to the lower end of the crossover unit by the usual threaded connection 13 and has a central passage 14 therethrough, through which the drilling fluid or air passes from the crossover passage 12, exiting into the bore hole PH through the bit B, and travelling upwardly in the bore hole through the annular space 15 defined between the bore hole wall and the drill pipe string P. The flow of the drilling fluid or air is operative to cool the cutters C of the bit B and to carry cuttings from the bottom of the bore hole upwardly to a suction inlet I, as the drilling progresses.

The suction inlet I leads from the bore hole annulus 15 into the central passage 16 of the inner pipe of the dual pipe P.

As shown in FIGS. *2a* and *2b*, the drill string P has been equipped with an expansible cutter, bore hole enlarging bit EB also having cutters C mounted on arms 17 which, as will be later described, are pivotally mounted to enable expansion of the cutters, as drilling progresses, to form an enlarged bore hole EH, commencing at a selected location 18 above the bottom of the pilot bore hole PH. The structure of the enlarging bit, as will also be later described, is such that air is circulated down the space A in the outer drill pipe, and a portion of the air flows through the cutters and a major portion of the air is jetted against the formation to lift cuttings to the suction inlet I. Here again also, the passage 16 is subjected to a vacuum to remove from the hole a quantity of air in excess of the volume supplied through the drill pipe, thereby creating a negative pressure at the top of the bore hole PH and inducing make-up air flow down the bore hole annulus.

Each drilling stage is more efficient than prior drilling methods, since the cuttings are not reground, and evacuation of the cuttings through the inner pipe, with attending air flow down the bore hole annulus is environmentally superior, since dust does not rise in the bore hole annulus. Economically, the operation is advantageous because the compressed air requirements are reduced.

In both drilling operations, vacuum is applied to an outlet hose 20 by a vacuum fan VF at the drilling ring. Cuttings and dust are removed from the return air by separator means. As shown, the outlet hose is connected to the inlet of a cyclone separator 21. Such separators, as is well known, remove the air by centrifugal action, solids discharging downwardly and air exiting from the top of the separator. Also as shown, air and residual dust from the cyclone separator are supplied to a second separator 22, which is preferably of the filter bag type capable of cleaning the dust from the air, so that air exiting from the vacuum fan is relatively clean.

The rotary drive D for the drill pipe P may be of any known type and is shown diagrammatically as including a housing or body 23 in which a drive pipe 24 is rotatably disposed. A packing 25 seals about the drive pipe, and suitable electric or hydraulic drive motors 26 have drive pinions 27 in mesh with a ring gear 28 mounted on the drive pipe. The drive pipe is connected to the upper end of the drill pipe P by a threaded pin and box joint 29, such as a joint J to be later described, so that the drill pipe is rotatable, as evacuated air and cuttings pass upwardly through the drive pipe bore 30. A fitting 31 is provided on the drive unit body for connection with the discharge hose 20.

The swivel S may be of any suitable construction providing for rotation of the drill pipe P while air is being supplied through the pipe 10 to the space A within the outer pipe OP. As shown, the swivel S has an outer, stationary body or housing 32 in which an inner mandrel 33 is rotatably mounted by upper and lower radial and thrust bearings 34. Upper and lower seal rings 35 are provided to prevent entry of foreign matter. The inlet pipe 10 communicates with an annular space 36 defined between the housing and the mandrel, and one or more radial ports 37 communicate between the annular 36 and the outer pipe passage A. An axially spaced pair of ring seals 38 prevent loss of air by sealing between the housing and the mandrel.

The expansible cutters C of the bit EB may be hydraulically expanded or hydraulically expanded and contracted, as will be later described. Accordingly, the swivel S also provides means for establishing a hydraulic connection between a hydraulic line 39 and a hydraulic passage 40 in the mandrel 39. Here again, an annular space 41 is provided between the housing and the mandrel, and a port 42 communicates between the annulus 41 and the passage 40. The annulus 41 is sealed between the housing and mandrel by the lower seal ring 38 and another seal ring 43 below the annulus 41.

Figure 10:
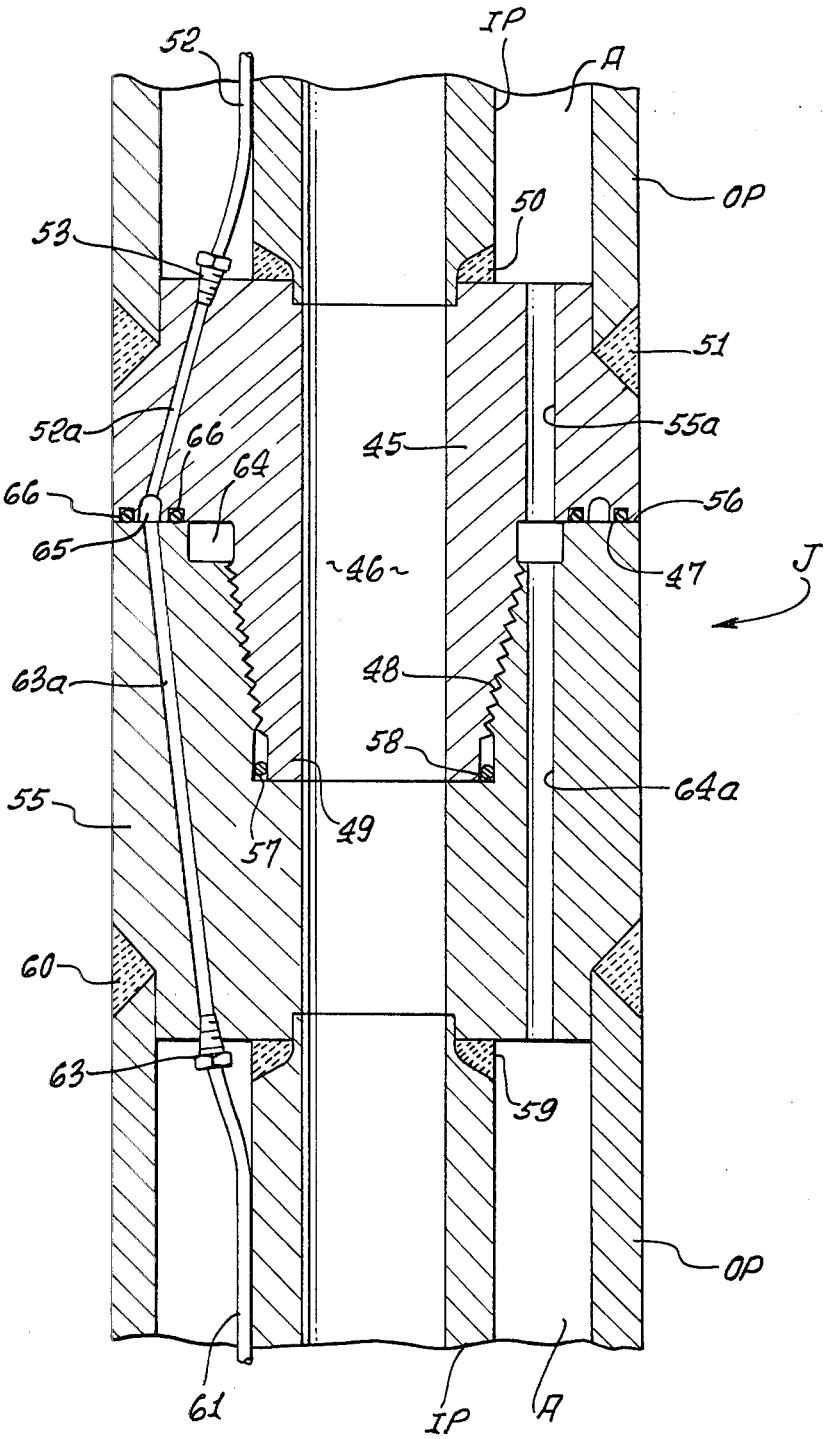
FIG. 10 is a fragmentary longitudinal section showing a typical pipe joint.

Connection of the swivel mandrel 33 to the downwardly extending drill pipe P and connection between extra lengths of pipe, when necessary to drill a hole deeper than one length of a pipe is accomplished by the tool joint J, shown in FIG. 10. The joint J is also constructed to conduct air and hydraulic fluid through the joint. The typical joint has a pin body 45 with a central bore 46. An external shoulder 47 extends circumferentially of the body 45 and the body has a tapered and threaded pin section 48 extending from below the shoulder 41 to the lower cylindrical end section 49. Inner pipe IP is welded to the pin body by a circumferentially continuous weld 50, an outer pipe OP being welded to the pin body by a circumferentially continuous weld 51, to form sealed connections and define the outer pipe space A. Before welding the outer pipe in place, one or more hydraulic tubes 52, in the case that the enlarging bit is hydraulically opened, or hydraulically opened and closed, is secured to the outside of the inner pipe and connected with a fitting 53 threaded into the pin body. The body is drilled at numerous circumferentially spaced locations **55*a*** to provide air passages leading longitudinally from the space A.

The companion joint part has an internally threaded box body 55, having an upper end shoulder 56 to abut with the pin shoulder 47 when the joint is threaded together. An internal seal ring seat 57 for a ring seal 58 is provided to receive the lower cylindrical end 49 of the pin body. Inner pipe IP is secured to the box body by a circumferentially continuous weld 59, and outer pipe OP is secured to the box body by a circumferentially continuous weld 60 forming seals for the space A. One or more hydraulic lines 61 are engaged in a fitting 63 installed on the inner pipe. Numerous drilled holes **64*a*** are provided and extend longitudinally in the box body in communication with space A.

When the joint J is made up, air can flow from the upper air space A to the lower air space A, through holes **55*a* and 64*a*, via an annular space 64 defined between the pin and box bodies. In addition, hydraulic fluid communication is established between lines 52 and 61 through actuator fluid passages 52*a* and 63*a* in the pin and box bodies, via an annular space 65 formed in the shoulder 47 of the pin body and sealed by a radially spaced pair of face seals 66**.

Referring to FIGS. *3a* and *3b*, *4a* and *4b*, an expansible cutter, hole opening bit EB and the lower end of the drill pipe P are shown diagrammatically, joints and assembly details being eliminated for clarity and simplicity of illustration of the improvements. Reference is made to my prior U.S. Pat. No. 4,187,920 for a more detailed illustration of one form of the bit construction.

The enlarging bit EB has an elongated inner body 150 on which is reciprocably mounted an outer body member 151. Air passages A in the pipe string communicate with air passages 152 in the inner body. Passages 152 have upper radial ports 153 and lower radial ports 154. Air supplied through passages A can pass through upper ports 153 into an annular chamber or cylinder 155 which is defined between a cylinder head or flange 156 in the outer body 151 and a lower shoulder 157 on the body section 151. As seen in FIGS. *3a* and *3b*, when the cutters are retracted, the lower air passage 154 is blocked by the inside wall of the outer body section 151. This structure, as will be later more fully described permits air to continuously flow to the cutters, through passages 159 extending downwardly in the body section 151, but when the cutters are expanded additional air flows from the bit via the lower ports 154.

In the bore hole enlarging bit constructions of my above-identified patents, air pressure supplied through passages A and ports 153 acts to provide a cutter expanding, upward force on the housing 151, but in the form shown herein, the enlarging bit EB is constructed to be expanded, as well as retracted, by hydraulic fluid pressure supplied through the swivel S, as described above.

The inner body 150 has an annular piston 160, provided with a side ring seal 161, disposed in a cylinder 162 of the outer body 151 above the flange or cylinder head 156. Head 156 has a side ring seal 163 slidably engaging the inner body section 150. At the upper end of the outer body 151 is a flange 164 having an internal ring seal 165 slidably engaging the body section 150, above piston 160.

As shown diagrammatically in FIGS. *3a* and *4a*, but as will be understood from the above description of a tool joint J, the pipe P has a pair of hydraulic lines 61 to supply pressure fluid to a pair of radial ports 61*a* and 61*b* in the inner bit body 150 which respectively open into the cylinder 162 above and below the piston 160. Pressurized hydraulic fluid can be supplied to a selected port 61*a* or 61*b* to force the outer housing 151 upwardly or downwardly relative to the inner body 150, to expand or retract the cutters.

In its preferred form, a four way valve V (FIG. *2c*) is installed in the swivel mandrel 33 to control communication between hydraulic passage 40 and a selected downwardly extending passage 61 and a vent 40*a*. However, if desired a pair of passages 40 can be employed in conjunction with a pair of hydraulic fluid supply conduits 39 and annular chambers 40. In either event, the expansible cutters can be expanded independently of the pressure of air used to cool the cutters, and the cutters can be rapidly expanded as the enlarging operation is commenced.

Figure 6:
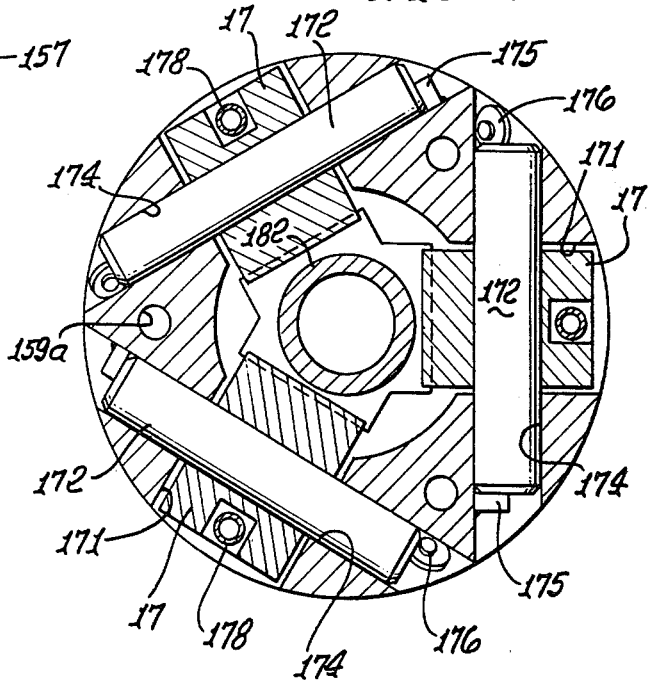
FIG. 6 is a transverse section as taken on the line 6—6 of FIG. 3*b;*
Figure 7:
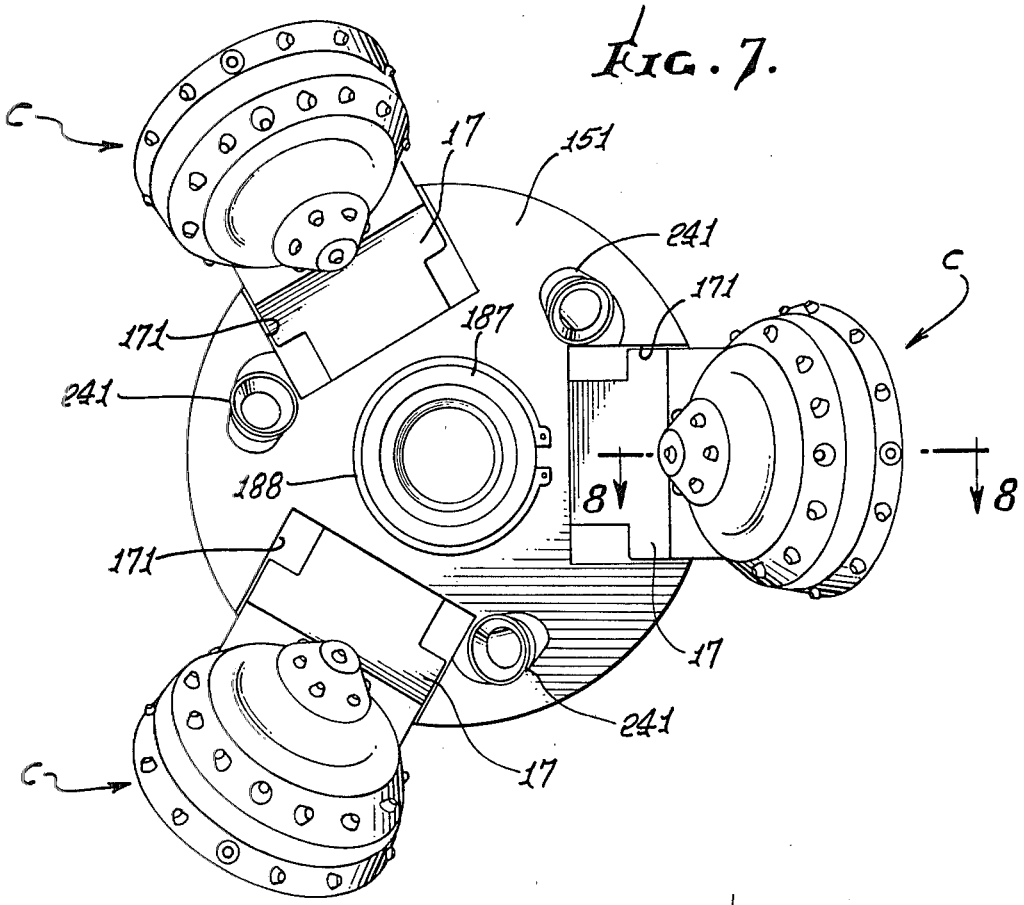
FIG. 7 is a bottom plan of the expanded bit of FIG. 4*b;*

Carried by the lower end section 169 of the body member 151, in a plurality of circumferentially spaced elongated slots 171, are the respective cutter support arms 17. Pivot pins 172 extend through the upper ends 173 of the cutter arms 17 and into alligned bores 174 at opposite sides of the slots. The pins engage at one end with a stop 175 and are retained in place by suitable screw members 176 threaded into the body as seen in FIG. 6.

As previously indicated, air from passages 159 in the body member 151 is adpated to be directed to the cutters C. Thus, the passages 159, at their lower ends, open into a bore 177, and a flexible, preferably metallic, fluid conductor 178 has a fitting 179 connected to the bore 177 and another fitting 180 which communicates with an elongated passage 181 formed in the bit support arm 17. In the illustrated embodiment, the bit arm 17 is a two part structure, including the pivot end and the cutter support end 17*b* joined together by a weld 17*c* with a tubular insert 17*d* providing for continuity of the fluid passage 159. Air supplied to the passages 159 is adapted to cool the cutters C in a manner to be described below.

The inner body or drive member 150 extends reciprocably within the outer member 151 and has at its lower end a cutter expander member 182 having a head 183 disposed in a seat 184 at the lower end of the body member 150 and retained in place by a suitable means such as a split retainer ring 185, which is in turn retained in place by balls 186 in opposed arcuate surfaces provided about the outer periphery of the split ring 185 and about the inner peripheral wall of the seat 184. The expander member 182 extends downwardly within the center of the outer body section 151 and through a bushing 187, which is retained in place by snap rings 188 within a bore provided in a web 189 at the lower end of the outer body member 151.

In the operation of the structure to expand the cutter supporting arm outwardly from the position of FIG. *3b* to the position of FIG. *4b*, an outward projection 193 in the expander member 182 is formed to engage a downwardly and inwardly, arcuately extended camming surface 194 provided on the inside of the respective support arms 17. At the lower end of the camming surface 194 is a locking surface 195 which, when the arm 17 is fully pivotally extended, as seen in FIG. *4b* is engaged by the cam member 193 to mechanically lock the arms in the expanded positions until reverse motion of the bit body members occurs. Upon such reverse motion of the bit body sections, a shoulder 196 projecting outwardly and facing inwardly on the expander member 182 is provided for engagement with a downwardly facing lug or projection 197 upon the upper end 173 of the respective support arm 17, whereby to pivotally shift the support arms 17 from the extended position of FIG. *4b* back to the retracted position of FIG. *3b*, enabling the bit structure to be removed from the hole on the drill pipe.

Figure 5:
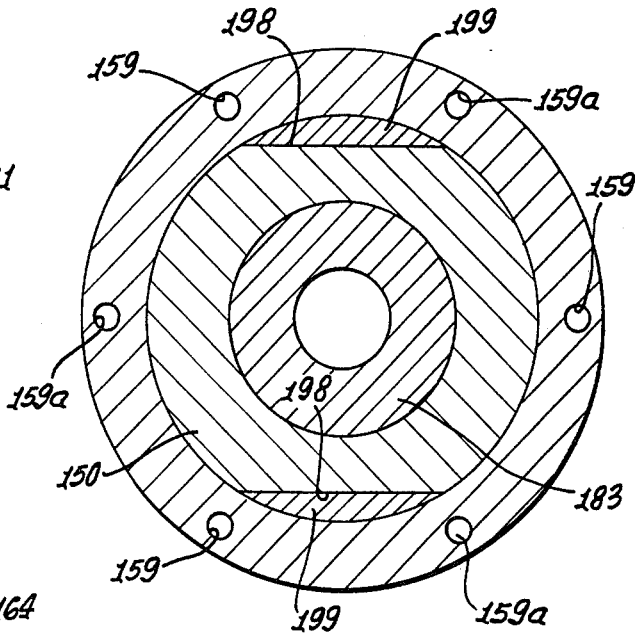
FIG. 5 is a transverse section as taken on the line 5—5 of FIG. 3*b;*

The inner bit body member 150 is a rotary drive member which is adapted to rotatably drive the outer bit body section 151, in response to rotation of the drill pipe string, so that the bit cutters are rotated or revolved about the axis of the bit. The rotary drive between the bit body sections is provided as shown in FIG. 5, wherein it will be seen that at opposite sides of the inner body section 150 are chordal flats 198 disposed in opposed relation and slidably enagageable with segmental torque transmitting members 199, which are carried within the outer body member 151 and suitably fixed in place as by weldments.

Figure 8:
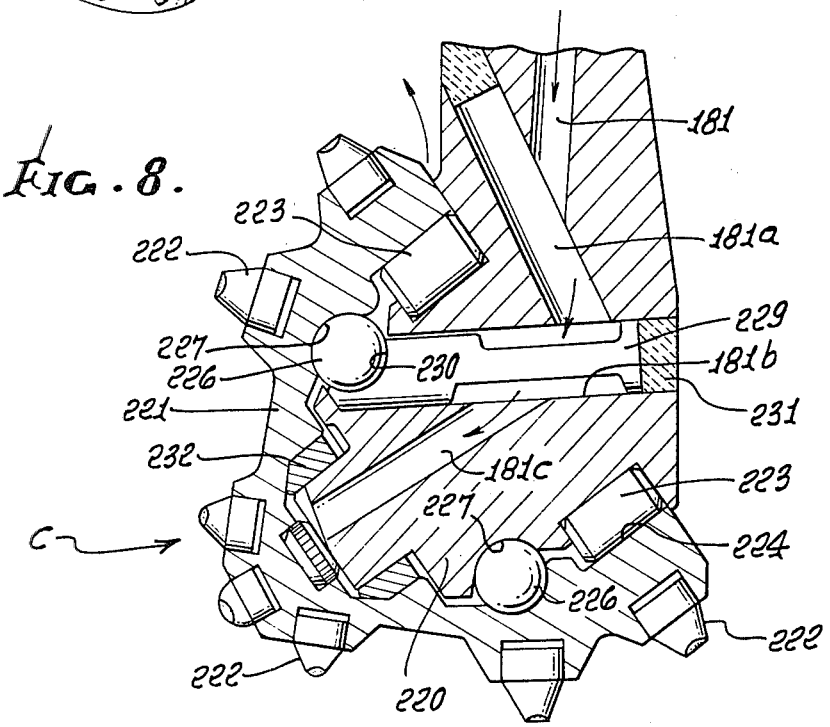
FIG. 8 is a fragmentary section as taken on the line 8—8 of FIG. 7.

Referring to FIG. 8, it will be seen that the cutter arm passages 181 are adapted to supply air to the cutters C to cool the same. The passages 181 communicate via passage 181*a* with a bore 181*b*, and from the bore 181*b* air can flow through a further passage 181*c*, which extends through the journal or mount 220 for the rotary conical cutter element 221, which carries suitable hard cutting inserts 222 arranged in an appropriate cutting pattern, as is well known. Between the journal or hub 220 of the cutter and the conical cutter element 221 are suitable roller bearings 223 engaging opposed parallel bearings surfaces 224 within the conical member and the hub. In addition, ball bearing elements 226 are disposed between opposed arcuate seats 227 on the hub and within the conical cutter element 221, these balls being supplied initially through the bore 181*b* and serving to rotatably retain the cutter element 221 on the hub. After the bearing balls 226 are installed, they are retained in place by a retainer 229 disposed in the bore 181*b* and providing an inner arcuate surface 230 corresponding to the surface 227 within the journal, and retainer 229 is then secured in place as by a weld 231. In addition, an end bearing or sleeve 232 is disposed between the reduced end of the journal 220 and the end bore within the conical member 221. The air passage 181*c* opens through the inner end of the journal 220, so that all of the air supplied through the passage 181 passes about the bearings 232, 226 and 223 as the air exits between the cutter cone and journal.

Figure 3B:
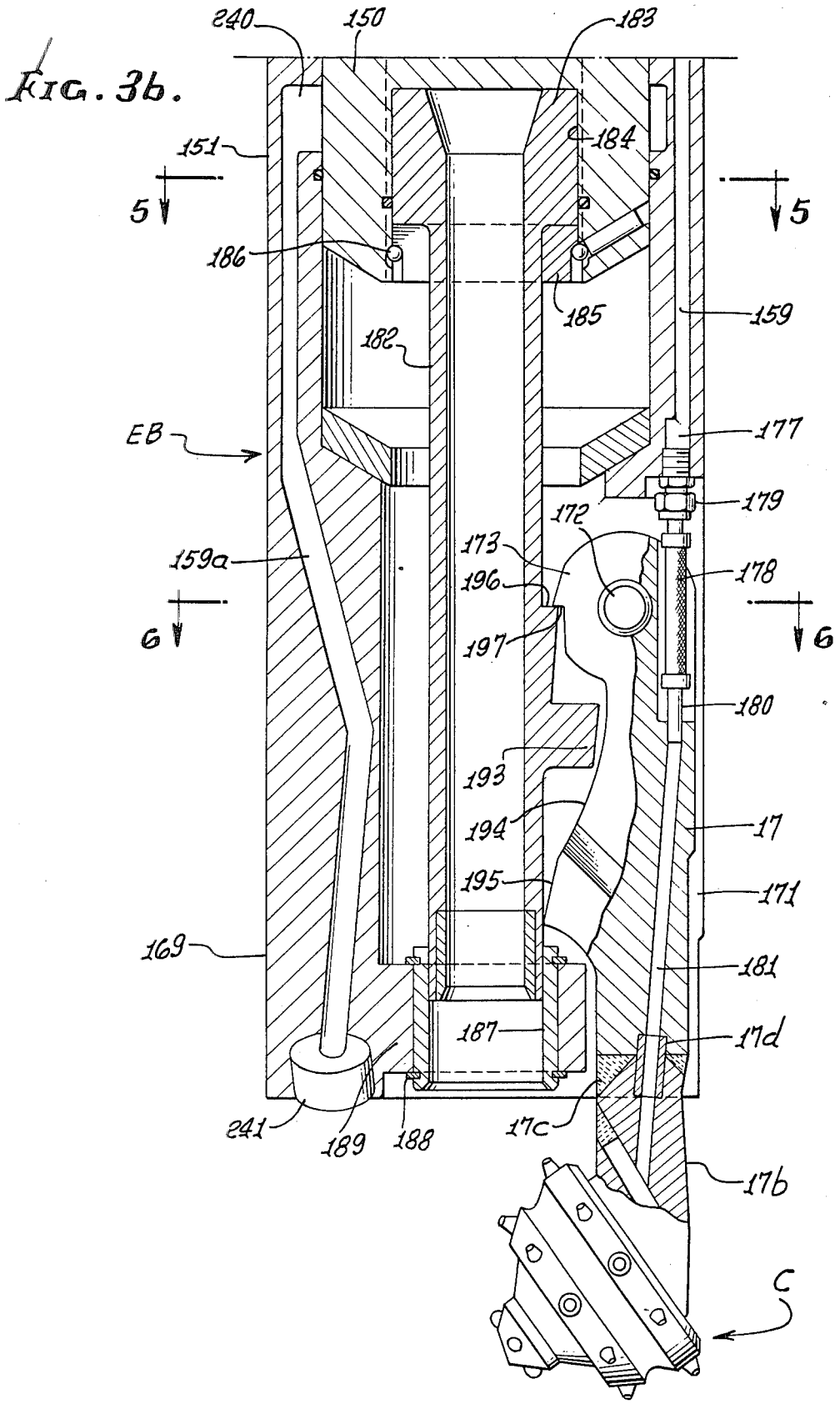
Figure 4A:
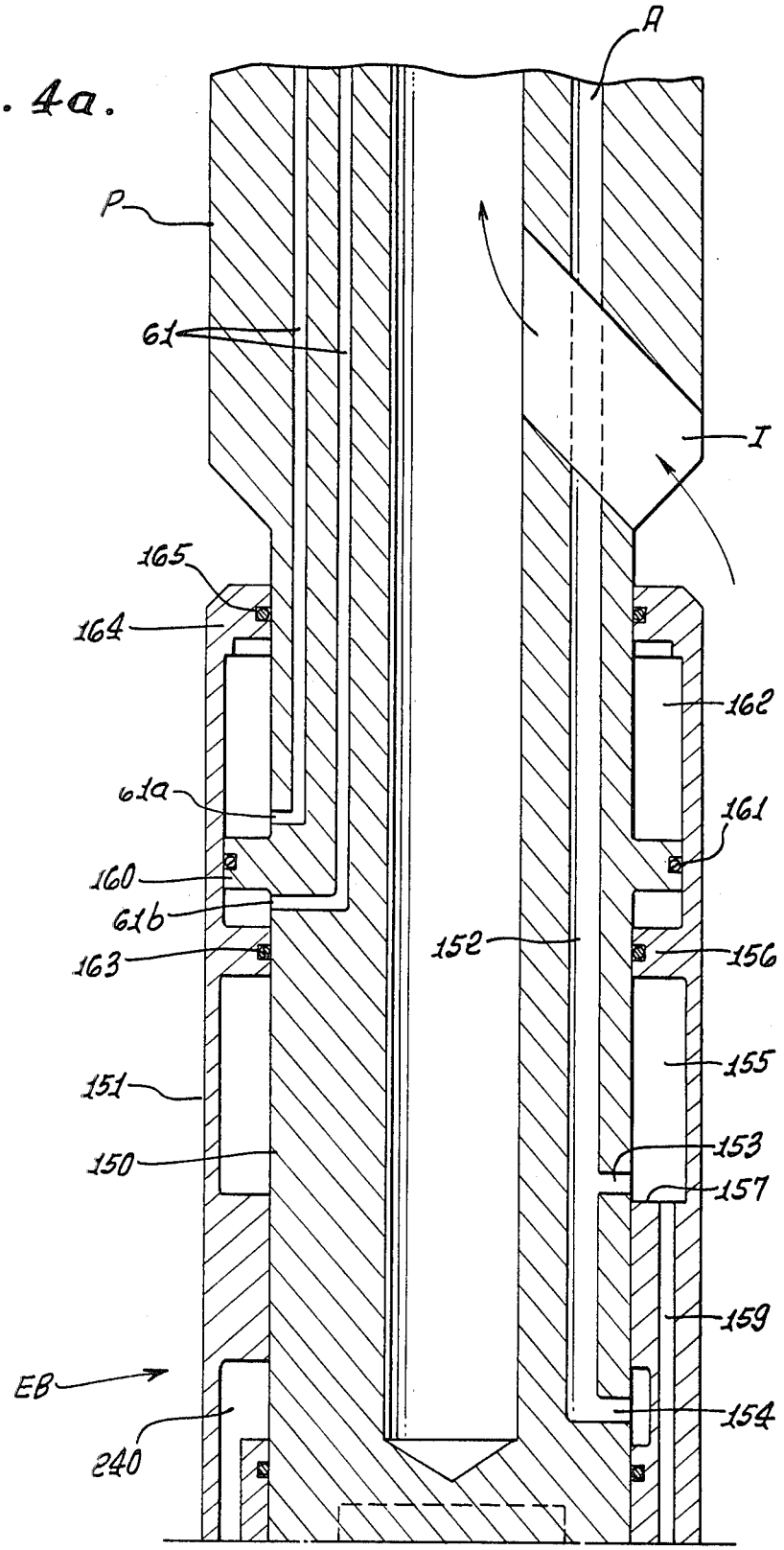
Figure 4B:
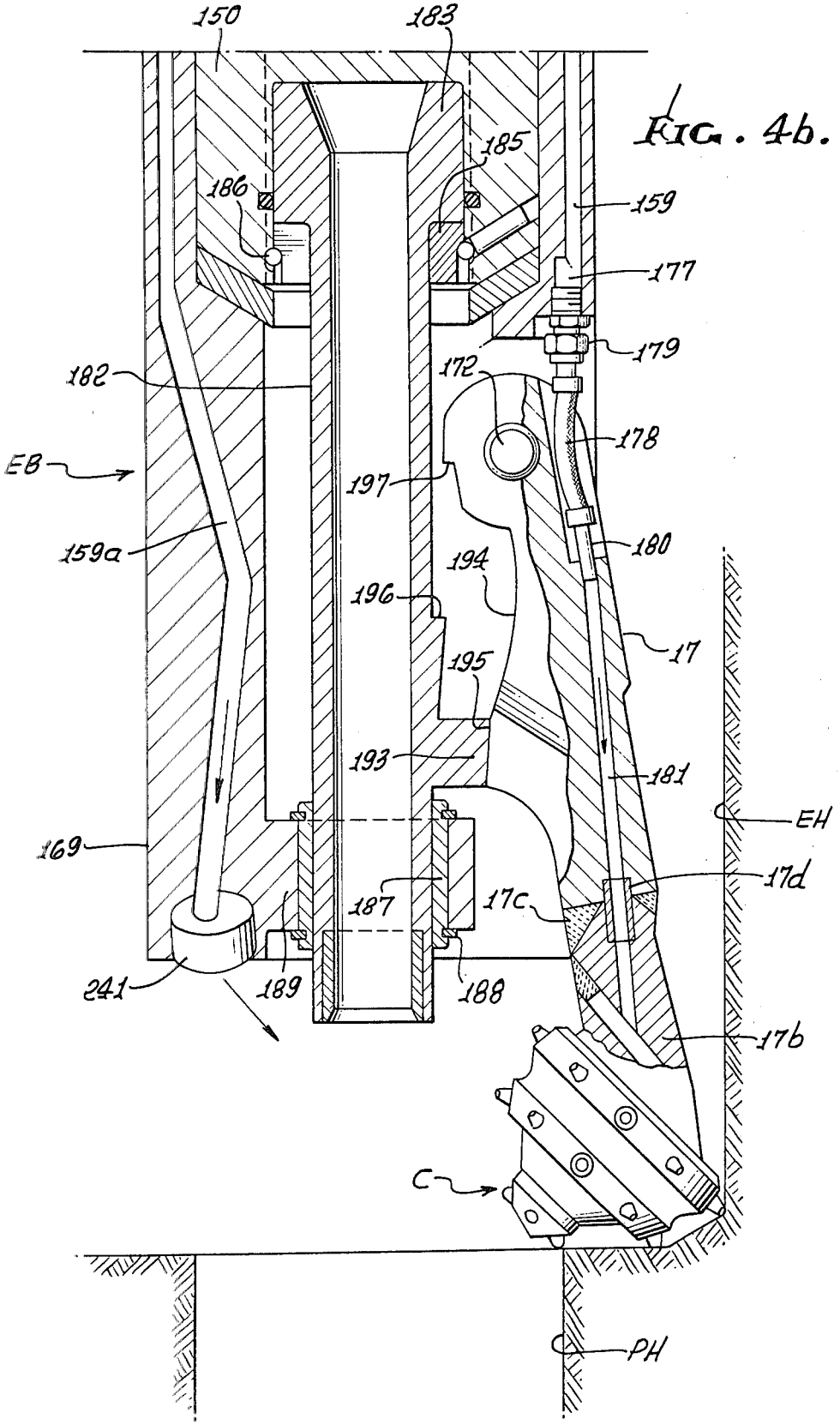

While, as previously indicated, the ports 159 leading from the chamber 155 to the fluid passages 181 and thence to the cutters allow sufficient flow to effectively cool the cutters during the initial hole opening operation, it is desired that, after expansion of the cutters to the positions of FIG. 4*b*, where they are mechanically locked in the outwardly xtended position, a larger volume of air be jetted at the cutters to cool them. Accordingly, again referring to FIG. 3*b*, it will be seen that additional fluid ports 159*a* are provided in the body member 151. These ports 159*a* are in communication with an annular space 240 in the outer body member and lead to nozzles 241 at the lower end of the body sections 151. These nozzle are directed towards the cutters, when expanded, to jet air against the formation and blow the cutter clean, while lifting the cuttings towards the suction inlet I.

Figure 3A:
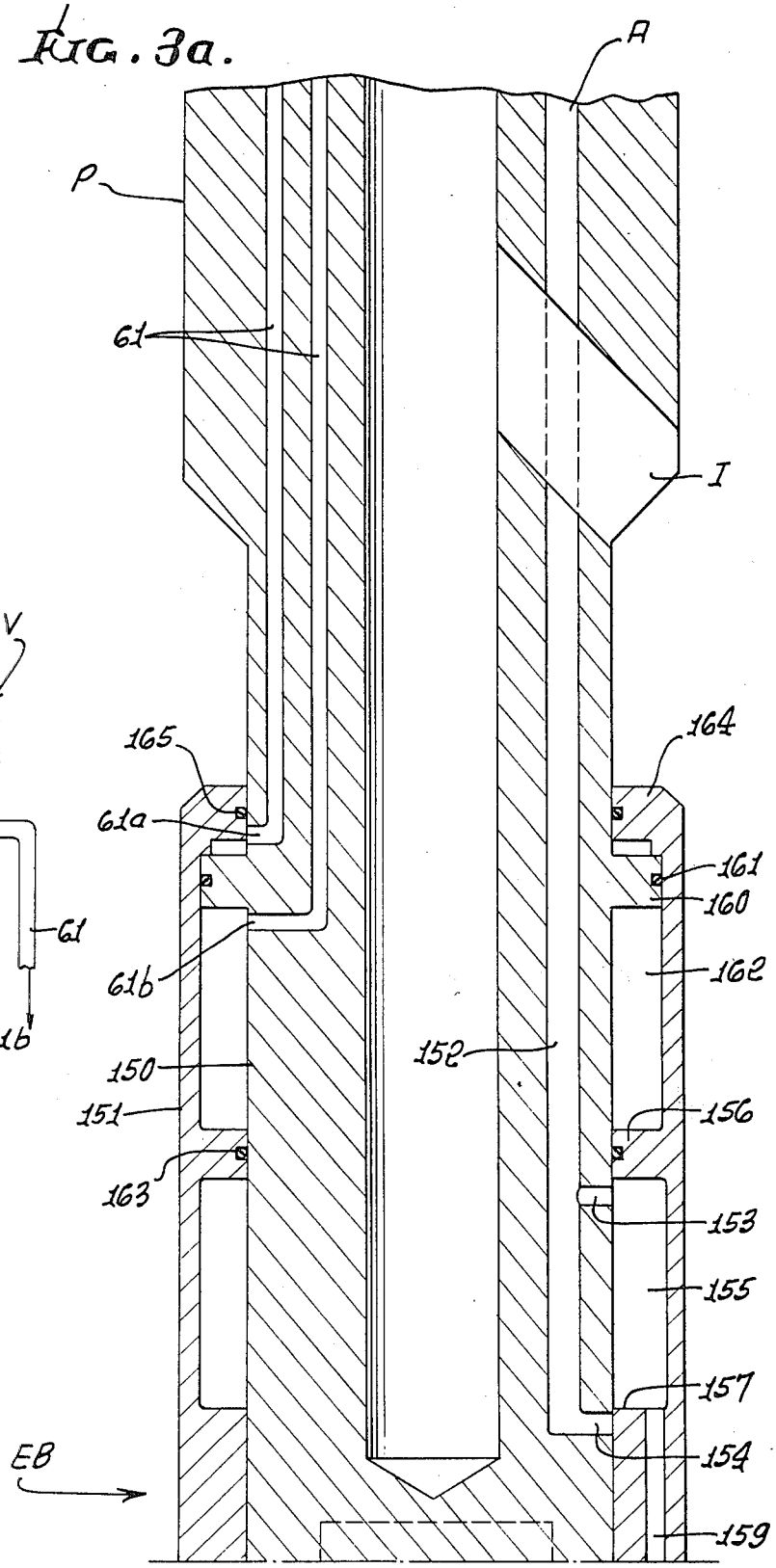
Figure 3C:
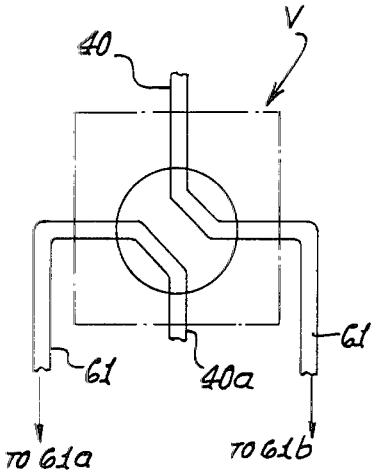

The lower port 154 from passage A, which is blocked when the cutters are retracted, as seen in FIG. 3*a*, move into the annular space 240, when the bodies are shifted to expand the cutters, so that air finds access to the jet passages 159*a*. Thus, while air is continuously supplied to the cutter bearings through port A and passages 159, but when port 154 enters the annulus 240, air is free to flow through passages 159*a* to the jets 241. This also provides a tattle tale indicating that the cutters are fully expanded.

In the case of the present expansible bit EB, after full expansion of the cutters, they are, as described above, mechanically held open by the expander 182. Accordingly, the hydraulic fluid pressure employed to expand the cutters need not be maintained during drilling. When the bore hole has been enlarged to the desired extent, the valve V can be actuated to enable fluid pressure to be supplied to port 61*b*, below the piston 160 on the inner bit body, so that pressure acting between piston 160 and the lower head 156 on the inner body 151 will shift the outer body downwardly to retract the cutters, as described above. During retraction, air can be circulated and the inner pipe can be evacuated to continue to vacuum dust and cuttings from the hole.

Figure 9:
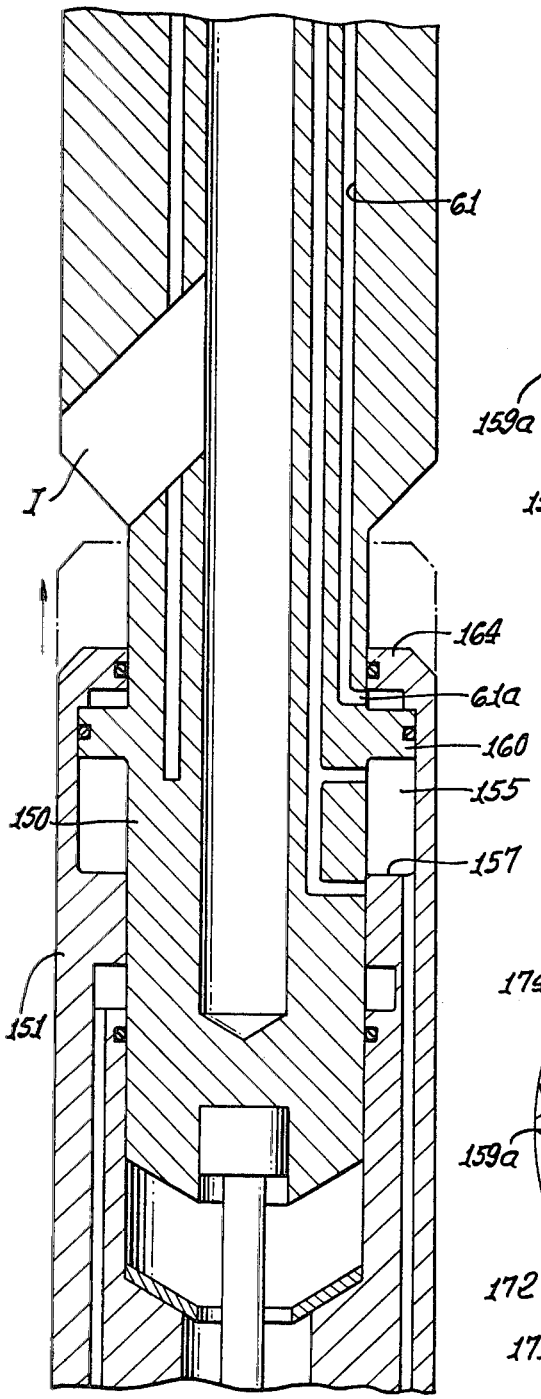
FIG. 9 is a fragmentary longitudinal section showing a modified construction of the expansible bit.

In FIG. 9, the bore hole enlarging bit EB is shown in a somewhat modified form, wherein only a single hydraulic passage 61 is employed, and a radial port 61*a* opens into the piston chamber between the piston 160 on the inner body 150 and the upper cylinder head 164 on the outer body 151. This is a somewhat simplified construction, in that the cylinder 162 and piston flange 156 of the first-described embodiment are eliminated, and air chamber or annulus 155 is defined between the piston 160 and the lower shoulder 157. Otherwise, the structure of FIG. 9 is like that of the first-described embodiment, so that no further description is necessary.

It will now be apparent that the present invention provides novel apparatus and a novel method for forming enlarged bore holes or blast holes by the two pass method, whereby the cuttings and dust are removed and controlled in a more efficient and economic manner, and whereby the operation is environmentally more desirable, since no dust can drift upwardly in the bore hole annulus. These advantages are realized by virtue of the circulation of drilling air down the outer pipe, while drawing return air through the suction inlet located down hole at a volume in excess of the supplied drilling air to cause make-up air flow down the bore hole annulus. These advantages, moreover, can be accomplished with the enlarging bit of my prior U.S. Pat. No. 4,187,920 or with the improved bit of the present application.

I claim:

1. A rotary bore hole enlarging bit adapted for connection with a rotary pipe string having a drilling fluid flow path and an acutator fluid flow path, said bit comprising: a body structure including inner and outer telescopic body sections; expansible and retractible cutter arms on said outer body section; expander means on said inner body section engageable with said cutters to expand the cutters upon telescopic movement of said body sections in one relative direction; piston and cylinder means defined between said inner and outer bodies to effect telescopic movement of said body sections; first passage means in said body structure and expansible cutters for conducting drilling fluid to said cutters from said drilling fluid flow path; and second passage means in said body structure for conducting actuator fluid to said piston and cylinder means from said actuator fluid flow path.

2. A rotary bore hole enlarging bit as defined in claim 1; said piston and cylinder means including an annular piston on one body section and a cylinder in the other body section; said second passage means including a pair of actuator fluid passages leading to said cylinder at opposite sides of said piston.

3. A rotary bore hole enlarging bit as defined in claim 1; said body sections defining a drilling fluid chamber therebetween; said first passage means communicating with said expansible cutters through said chamber; said first passage means also including a port disposed in said inner body section when said cutters are retracted; and additional passage means in said inner body communicating with said port when said cutters are expanded and opening in a direction towards said expanded cutters.

4. A rotary bore hole enlarging bit as defined in claim 1; said piston and cylinder means including an annular piston on one body section and a cylinder in the other body section; said second passage means including a pair of actuator fluid passages leading to said cylinder at opposite sides of said piston; said body sections defining a drilling fluid chamber therebetween; said first passage means communicating with said expansible cutters through said chamber; said first passage means also including a port disposed in said inner body section when said cutters are retracted; and additional passage means in said inner body communicating with said port when said cutters are expanded and opening in a direction towards said expanded cutters.

5. A rotary bore hole enlarging bit adapted for connection with a rotary pipe string having a drilling fluid flow path and an actuator fluid flow path, said bit comprising: a body structure including inner and outer telescopic body sections; expansible and retractible cutter arms on said outer body section; expander means on said inner body section engageable with said cutters to expand the cutters upon telescopic movement of said body sections in one relative direction; piston and cylinder means defined between said inner and outer bodies to effect telescopic movement of said body sections; first pasage means in said body structure and expansible cutters for conducting drilling fluid to said cutters from said drilling fluid flow path; and second passage means in said body structure for conducting actuator fluid to said piston and cylinder means from said actuator fluid flow path; said inner body section and said cutters having means for retracting said cutters upon telescopic movement of said body sections in the other direction.

6. A rotary bore hole enlarging bit adapted for connection with a rotary pipe string having a drilling fluid flow path and an acutator fluid flow path, said bit comprising: a body structure including inner and outer telescopic body sections; expansible and retractible cutter arms on said outer body section; expander means on said inner body section engageable with said cutters to expand the cutters upon telescopic movement of said body sections in one relative direction; piston and cylinder means defined between said inner and outer bodies to effect telescopic movement of said body sections; first passage means in said body structure and expansible cutters for conducting drilling fluid to said cutters from said drilling fluid flow path; and second passage means in said body structure for conducting actuator fluid to said piston and cylinder means from said actuator fluid flow path; said inner body section and said cutters having means for retracting said cutters upon telescopic movement of said body sections in the other direction; said body sections defining a drilling fluid chamber therebetween; said first passage means communicating with said expansible cutters through said chamber; said first passage means also including a port disposed in said inner body section when said cutters are retracted; and additional passage means in said inner body communicating with said port when said cutters are expanded and opening in a direction towards said expanded cutters.

* * * * *